US010136783B2

(12) United States Patent
Jung et al.

(10) Patent No.: US 10,136,783 B2
(45) Date of Patent: Nov. 27, 2018

(54) SUCTION APPARATUS FOR CLEANING PURPOSES

(71) Applicant: Hilti Aktiengesellschaft, Schaan (LI)

(72) Inventors: Steffen Jung, Bietigheim-Bissingen (DE); Martin Foell, Winnenden (DE); Dirk Moell, Weissach i. T. (DE); Rainer Engelhardt, Leutenbach (DE)

(73) Assignee: Hilti Aktiengesellschaft, Schaan (LI)

( * ) Notice: Subject to any disclaimer, the term of this patent is extended or adjusted under 35 U.S.C. 154(b) by 179 days.

(21) Appl. No.: 15/315,492

(22) PCT Filed: Jun. 1, 2015

(86) PCT No.: PCT/EP2015/062141
§ 371 (c)(1),
(2) Date: Dec. 1, 2016

(87) PCT Pub. No.: WO2015/185500
PCT Pub. Date: Dec. 10, 2015

(65) Prior Publication Data

US 2018/0140147 A1 May 24, 2018

(30) Foreign Application Priority Data

Jun. 2, 2014 (DE) ..... 10 2014 107 732

(51) Int. Cl.
*A47L 9/14* (2006.01)
*A47L 7/00* (2006.01)
*B08B 15/04* (2006.01)

(52) U.S. Cl.
CPC ..... *A47L 9/1427* (2013.01); *A47L 7/0033* (2013.01); *A47L 7/0095* (2013.01); *B08B 15/04* (2013.01)

(58) Field of Classification Search
CPC .... A47L 7/0033; A47L 7/0095; A47L 9/1427; B08B 15/04
See application file for complete search history.

(56) References Cited

U.S. PATENT DOCUMENTS 3,320,727 A * 5/1967 Farley ..... A47L 9/125 15/327.1
4,133,769 A * 1/1979 Morgan, Jr. ..... B01D 29/23 210/455

(Continued)

FOREIGN PATENT DOCUMENTS

DE 202007018176 U1 * 3/2008 ..... B08B 15/04
DE 20 2007 018 176 U1 4/2008

OTHER PUBLICATIONS

PCT/EP2015/062141, International Search Report (PCT/ISA/210 and PCT/ISA/220) dated Aug. 6, 2015, with partial English translation, enclosing Written Opinion of the International Searching Authority (PCT/ISA/237) (Fourteen (14) pages).

*Primary Examiner* — Marc Carlson
(74) *Attorney, Agent, or Firm* — Crowell & Moring LLP

(57) ABSTRACT

A suction apparatus for cleaning purposes includes a container, a suction subassembly, a filter element arranged in a container interior, and a pumping subassembly, where a mixture of a carrier fluid and particles of dirt can be taken in via a suction inlet and the particles of dirt are restrained by the filter element. The filter element is a filter bag through which the mixture is taken in by the suction subassembly. A filter bag restraining part subdivides the container interior into a filter bag accommodating space and a fluid delivery space, where the filter bag is arranged in the filter bag accommodating space and is prevented, by the filter bag restraining part, from expanding into the fluid delivery (Continued)

space, from which carrier fluid flowing around, or through, the filter bag restraining part is delivered by the pumping subassembly.

29 Claims, 15 Drawing Sheets

(56) References Cited

U.S. PATENT DOCUMENTS 4,179,768 A * 12/1979 Sawyer ..... A47L 7/0019 15/352
4,466,155 A * 8/1984 Grave ..... A47L 11/30 15/321
4,811,453 A * 3/1989 Lubraniecki ..... A47L 9/1418 15/347
5,263,225 A * 11/1993 Winters ..... A47L 7/0014 15/353
6,079,076 A * 6/2000 Berfield ..... A47L 7/0028 15/321
8,070,862 B2 * 12/2011 Woo ..... B01D 39/1623 55/382
2001/0005983 A1 * 7/2001 Berfield ..... A47L 7/0019 55/368
2004/0211160 A1 * 10/2004 Rammig ..... A47L 9/12 55/382
2005/0132676 A1 * 6/2005 Nhan ..... A47L 5/365 55/374
2007/0022565 A1 * 2/2007 Mayes ..... A47L 9/1427 15/347
2010/0192980 A1 * 8/2010 Turner ..... A47L 5/365 134/21
2011/0239399 A1 * 10/2011 Duncan ..... A47L 5/365 15/347

* cited by examiner

SUCTION APPARATUS FOR CLEANING PURPOSES

This application claims the priority of International Application No. PCT/EP2015/062141, filed Jun. 1, 2015, and German Patent Document No. 10 2014 107 732.6, filed Jun. 2, 2014, the disclosures of which are expressly incorporated by reference herein.

BACKGROUND AND SUMMARY OF THE INVENTION

The invention concerns a suction apparatus for cleaning purposes, comprising a container having a container interior, a changeable-shape filter element, which can be arranged in the container interior, and a pumping subassembly, wherein a mixture made up of a carrier fluid and entrained particles of dirt can be taken in via a suction inlet by means of negative pressure generated by the suction subassembly, and the particles of dirt are restrained by the filter element, and wherein the carrier fluid filtered by the filter element can be delivered by the pumping subassembly from a container interior to a fluid outlet.

Such a suction apparatus is described, for example, in DE 20 2007 018 176 U1.

The suction apparatus is used in combination with an electric tool, for example a core boring machine. Particles of dirt collecting on a bore crown of the core boring machine are caught by the carrier fluid and fed to the suction apparatus via a suction hose connected to the suction inlet. The particles of dirt are separated in a bag-like filter element. The carrier fluid is filtered by the filter element and delivered to the fluid outlet by a submersible pump arranged in the container interior. To the fluid outlet is connected a feed line that combines the suction apparatus with an extraction hood at the bore crown of the core boring machine. In the suction apparatus, negative pressure is generated by means of a blower, which is arranged in an apparatus upper part and which is arranged above the opened, bag-like filter element. The sucked-in mixture slows down due to the cross sectional expansion upon entering the suction apparatus and arrives thereby in the filter element. The air extraction takes place directly above the filter element with the suction subassembly, which requires a cartridge filter at the entry side of the suction apparatus.

As a result, the generating of negative pressure in the suction apparatus proves to be inefficient on the whole. Moreover, there is the risk that fluid particles will scatter upon entering the suction subassembly and moisten the cartridge filter. This significantly reduces the performance of the suction apparatus.

A suction apparatus of the type stated above can be used not only in the circulation mode described above in which fluid is suctioned from a work location and redelivered there.

Alternatively or additionally, it is conceivable that the suction apparatus is used merely to deliver and clean the carrier fluid mixed with particles of dirt, wherein this fluid is then delivered to the drainage system or a reservoir.

The task of the present invention is to provide a suction apparatus according to its classification which can be made to operate more reliably.

This task is solved for a suction apparatus of the type stated above according to the invention in that the filter element is a filter bag through which the mixture is taken in by the suction subassembly, and that the suction apparatus comprises a filter bag restraining part, which subdivides the container interior into a filter bag accommodating space and a fluid delivery space, wherein the filter bag is arranged in the filter bag accommodating space and is prevented by the filter element restraining part from expanding into the fluid delivery space, from which carrier fluid flowing around, or through, the filter element restraining part is delivered by the pumping subassembly.

For the suction apparatus according to the invention, a very good filter effect can be achieved in that a suction flow is provided that is directed through the filter element configured as a filter bag. Fluid streaming in reaches the filter bag, for example by a suction nozzle engaging this bag, wherein the extraction hose is connected to the suction nozzle. In the filter bag, the particles of dirt can be effectively separated, and the suction air reaches the suction subassembly through the filter bag.

A cartridge filter on the entry side of the suction subassembly, as in the suction apparatus described in DE 20 2007 018 176 U1, can be spared.

With the suction subassembly having the same dimensions, high efficiency can be achieved thereby. In addition, the suction apparatus comprises the filter bag restraining part, which subdivides the container interior into the filter bag accommodating space and the fluid delivery space. The filter bag is arranged in the filter bag accommodating space and is prevented by the filter bag restraining space from expanding into the fluid delivery space. The advantage of this is that the filter bag inflating as a result of negative pressure does not displace the fluid arranged in the container interior to such an extent that this fluid can reach the suction subassembly and impair its function. This configuration proves to be advantageous especially when switching on the suction apparatus with initial inflation of the filter bag and upon surge-like loading. Preventing an expansion of the filter bag into the fluid delivery space further offers the advantage that the entry opening of a fluid line, which is arranged therein, or of the pumping subassembly cannot be blocked by the inflating filter bag.

In this way it is ensured that fluid can be reliably delivered by the pumping subassembly. For the suction apparatus described in DE 20 2007 018 176 U1, by contrast, there is the risk that the filter element being filled with particles of dirt will block the fluid stream toward the entry side of the submersible pump and the electronic tool will be undersupplied with fluid.

It is favorable if the volume of the filter bag in an inflated state is greater than the volume of the filter bag accommodating space, wherein the filter bag arranged in the filter bag accommodating space is prevented by the filter bag restraining part from inflating to its maximum size. Here a particular meaning of this can be that the filter bag restraining part prevents the filter bag from being inflated as much as it could be if arranged outside the container. This affords the possibility of using the largest possible filtering area of the filter bag in order to clean the (carrier) fluid with particular effectiveness. In addition, the filter bag restraining part ensures that the filter bag does not expand into the fluid delivery space.

It proves to be advantageous if the filter bag restraining part comprises or forms at least one support section for the filter bag and/or at least one lateral contact section, for example in the form of a lateral bracing section, for the filter hag. The support on the support section or the contact on the contact section ensures that the filter bag being filled with particles of dirt is not damaged due to increasing weight. The particles of dirt can be deposited on the bottom of the filter bag, and the fluid can flow out of the filter bag above the particles of dirt. For example, the fluid flows past the lateral contact section into the fluid delivery space.

The support section and/or the contact section can be configured preferably to be flat. The filter bag restraining part thereby exhibits a rugged form so that the filter bag can be reliably supported even when very full.

Favorably, rib-shaped and/or nub-shaped projection elements are provided on the support section and/or on the contact section in order to avoid flat contact between the filter bag and the filter bag restraining part. The projection elements can also be provided for a flat configuration of the support section and/or of the contact section, as mentioned above. The projection elements can ensure that the filter bag does not lie flat on the filter element holding part over a large area and as a result cling under the load of the received particles of dirt.

Instead, the possibility exists that fluid can also pass through the filter bag in the region of the projection elements.

Especially in the last-mentioned advantageous embodiment, it is favorable if an area of the fluid delivery space is arranged between the support section and a bottom wall of the container. In other words, the fluid delivery space extends into an area of the container interior that is arranged below the support section, at least in sections. Fluid exiting the filter bag can thereby collect below the filter bag restraining part and be delivered from it.

Preferably, the filter bag restraining part exhibits at least one flow-through opening for filtered fluid.

It can be preferably provided that intermediate spaces through which fluid can flow are arranged between side walls of the container and the filter bag restraining part. For example, the filter hag restraining part extends between two opposing side walls of the container and is distanced from a respective side wall. Through the existing intermediate space, fluid exiting the filter bag can flow into the fluid delivery space.

In a direction transverse to the above stated direction, the filter hag restraining part can be arranged form-fitting between walls or wall sections of the container and rest against this container.

It proves to be advantageous if the filter hag restraining part is supported against a bottom wall of the container and if the suction apparatus comprises a fixing device to fix the filter hag restraining part against vertical motion. Preferably, the filter hag can rest on the filter bag restraining part, so that the weight of the filter bag can be diverted to the bottom wall.

Favorably, the filter bag restraining part can be detachably fixed to the container, preferably manually and/or without any tool, via a fixing device, in particular the fixing device mentioned above. For example, the fixing takes place by latching and/or clamping with the container.

The filter bag restraining part comprises or forms preferably a partition wall that separates the filter bag accommodating space and the fluid delivery space from each other. The partition wall can be configured, for example, in a half-channel shape or in a channel shape. The half-channel form is given to the filter bag restraining part, for example, by the aforementioned support section and the lateral bracing section, as a result of which the filter hag can rest on the restraining part and can be laterally supported against this part.

For example, the partition wall exhibits a roughly step-shaped form with a first ledge that forms the support section, a vertically extending section that forms the lateral contact section and a second ledge on which, as explained further below, orienting elements and/or connecting elements can be arranged.

The filter bag accommodating space is preferably arranged above the partition wall and the fluid delivery space preferably below the partition wall.

For example, the filter hag accommodating space is limited on the bottom and laterally by the support section and by the contact section, and the fluid delivery space on the top by the support section and laterally by the contact section.

It can be provided that the filter hag restraining part is configured so that the filter hag accommodating space and the fluid delivery space are roughly equal in size.

Favorably, the filter hag is a non-woven bag or comprises such a non-woven bag.

It proves to be advantageous if the suction apparatus exhibits a holding element that can be mounted on the container for the filter hag to which the filter bag can be detachably fastened. The filter bag can be fastened to the holding element and then mounted on the suction apparatus. To remove the filter bag, the holding element can be unmounted and then separated from the filter bag.

It is favorable if the filter bag restraining part exhibits or forms a display device having a fill indicator for fluid to be filled into the container space. For example, the fill indicator tells the user what the maximum level should be for fluid to be filled into the container space.

In an advantageous embodiment of the suction apparatus according to the invention, it is favorable if the suction apparatus comprises an apparatus lower part exhibiting the container and an apparatus upper part exhibiting the suction subassembly, which part can be sealingly set onto the apparatus lower part and is detachable from it. The filter bag restraining part is preferably an integral part of the apparatus lower part and arranged in the container.

It proves to be advantageous if the pumping subassembly is arranged in the apparatus upper part, if the suction apparatus exhibits a discharge line forming the fluid outlet that is connected to a pressure side of the pumping subassembly, and if the suction apparatus exhibits a feed line which is connected to a suction side of the pumping subassembly and is arranged at the entry opening, which is arranged in the fluid delivery space, for filtered carrier fluid. The pumping subassembly in the apparatus upper part can take in fluid from the fluid delivery space through the feed line. Fluid can be delivered to the fluid outlet via the discharge line.

Favorably, the entry opening is arranged at a distance from a bottom wall and/or side walls of the container. If particles of dirt undesirably reach the fluid delivery space, they settle against the bottom wall of the container. By providing a distance between the entry opening from the bottom wall, the likelihood is reduced that particles of dirt can enter the feed line. Distance from side walls of the container is advantageous, for instance, whenever the fluid flow from the filter hag accommodating space into the fluid delivery space, as mentioned above, takes place along side walls past the filter bag restraining part. It is very unlikely that particles of dirt entrained by the fluid flow will reach the feed line as a result.

Another filter element is preferably arranged at the inlet opening in order to filter out any present particles of dirt.

For a different advantageous embodiment, it can be provided that the pumping subassembly is a submersible pump arranged in the fluid delivery space, and that the suction apparatus exhibits a discharge line, forming the fluid outlet, that is connected to a pressure side of the submersible pump. The submersible pump suctions fluid from the fluid delivery space and delivers it to the fluid outlet via the discharge line.

It proves to be advantageous if the feed line connected to the pumping subassembly arranged in the apparatus upper part or the discharge line connected to the submersible pump exhibits a first line section arranged at least sectionally in the fluid delivery space and a second line section arranged at least sectionally in the apparatus upper part, which sections are interconnected fluid-tight via respective connecting elements when the apparatus upper part is positioned on the device lower part, wherein the connecting elements are separated from each other upon lifting the apparatus upper part from the apparatus lower part. This can, to a certain extent, provide and separate an "automatic" fluid connection. If the apparatus upper part is set onto the apparatus lower part, the respective connecting elements of the two line sections couple to each other. For example, standardized, commercially available plug couplings are used by which the line sections are connected to each other. If the apparatus upper part is separated from the apparatus lower part, the fluid connection between the line sections is stopped by the connecting elements being separated from each other. Such a configuration can be used for the aforementioned embodiment where the pumping subassembly is arranged in the apparatus upper part. Accordingly, the feed line can be subdivided into two line sections. The configuration can also be used for the aforementioned embodiment where the pumping subassembly is configured as a submersible pump in the fluid delivery space. The discharge line can be subdivided into two line sections for this embodiment.

The connecting element of the first line section is preferably fixed to a holding part held to the apparatus lower part. By being fixed to the holding part, the connecting element can occupy a defined position so that when the apparatus upper part is set onto the apparatus lower part the connecting element can reliably couple with the other connecting element. The holding part can be held to the apparatus lower part, for example, through latching and/or clamping.

Optionally, for a suction apparatus of the type stated above, it can be provided that the connecting element of the first line section is fixed to a holding part held to the apparatus lower part. This defines a separate invention independent of the possible presence of the filter bag restraining part.

It proves to be especially advantageous if the filter bag restraining part comprises or forms the holding part. As a result, a configuration that has an especially simple design can be achieved for which a separate holding part can be spared. Accordingly, a connecting element of the first line section can be fixed to the filter bag restraining part. With this connecting element, the further connecting element on the apparatus upper part can be connected fluid-tight.

The aforementioned second ledge of the step-shaped filter element restraining part forms in particular a section of the same to which the connecting element is fixed.

It can be provided that the first line section of the feed line comprises a hose line at the end of which the entry opening is arranged. The hose line is connected, for example, to the connecting element of the line section.

The hose line can be fixed to the filter bag restraining part, for example through latching and/or clamping.

It proves to be advantageous if the apparatus upper part and the filter bag restraining part exhibit interacting orienting elements that interact when the apparatus upper part is set onto the apparatus lower part. The orienting elements make it easier for a user to orient the apparatus upper part relative to the apparatus lower part. For example, the orienting elements couple with each other when the apparatus upper part is lowered, but is not yet resting on the apparatus lower part. In particular, the apparatus upper part can be guided by the orienting elements into the correct target position on the apparatus lower part.

The orienting elements comprise, for example, at least one pin-shaped projection and at least one blind hole-shaped socket in which the projection engages. The at least one projection is, for example, arranged on the filter bag restraining part and the at least one socket on the apparatus lower part.

It can be provided in particular that in each case two or more orienting elements are present on the filter bag restraining part and on the apparatus upper part.

Favorably, two respective orienting elements are provided between which the connecting elements are positioned. As a result, the orienting elements also make it possible to ensure that the connecting element on the apparatus lower part and the connecting element on the apparatus upper part are correctly oriented to each other and when the apparatus upper part is set onto the apparatus lower part they can to a certain extent "automatically" couple to each other.

It is advantageous if the apparatus upper part impacts the filter bag restraining part, when it is set onto the apparatus lower part, with a force directed at the apparatus lower part. The filter bag restraining part can thereby be held in correct target position on the apparatus lower part. It is also possible in particular that an incorrectly positioned filter bag restraining part is moved into the correct target position at the apparatus lower part by lowering the apparatus upper part.

It is favorable if the filter hag restraining part is a single piece and/or is manufactured from a synthetic material.

The following description of a preferred embodiment of the invention serves to further explain the invention in context with the drawings.

DETAILED DESCRIPTION OF THE DRAWINGS

Figure 1:
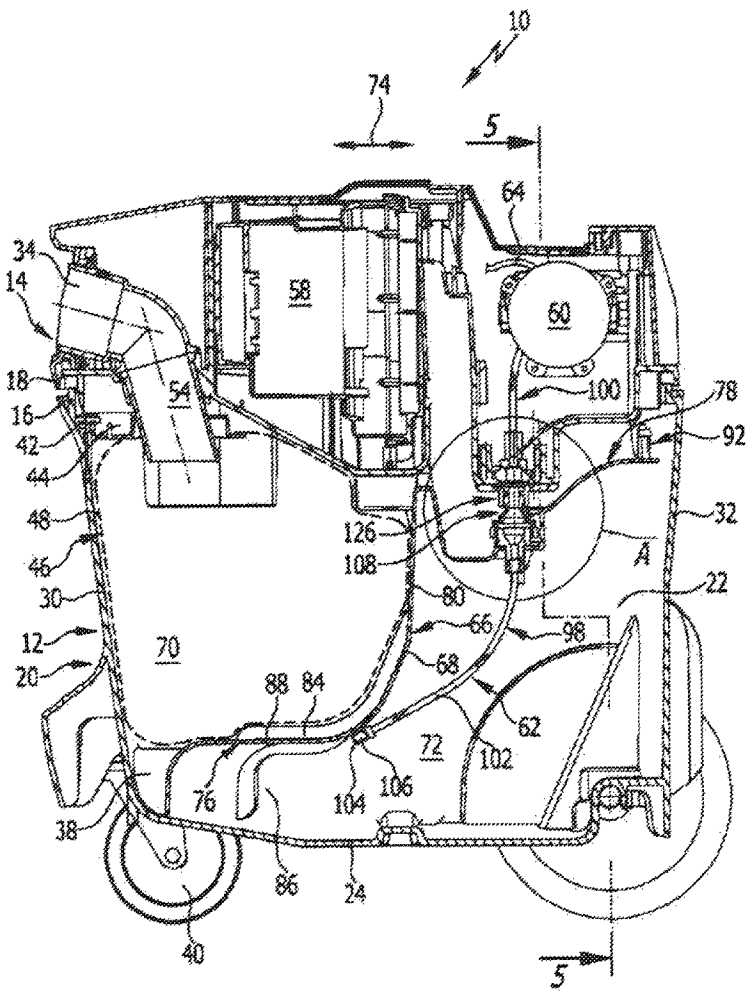
FIG. 1: a simplified longitudinal sectional representation of a suction apparatus according to the invention, comprising an apparatus lower part and an apparatus upper part set onto the apparatus lower part.

FIG. 1 shows an advantageous embodiment, which is labeled with reference number 10, of a suction apparatus according to the invention. The suction apparatus 10 is used, for example, in combination with an electric tool not shown in the drawing. The electric tool can be, for example, a core boring machine for which particles of dirt appearing at the bore crown are captured by a carrier fluid and are fed to the suction apparatus 10 via a suction hose not shown in the drawing. The carrier fluid can be delivered inversely by the suction apparatus 10 to the core boring machine via a feed hose not shown in the drawing.

The suction apparatus 10 can also be operated separately in that the carrier fluid having particles of dirt is cleaned and is fed by the suction apparatus 10 into a reservoir or the drainage system.

The suction apparatus 10 comprises an apparatus lower part 12 and an apparatus upper part 14 that can be detachably set onto the apparatus lower part. The apparatus lower part 12 and the apparatus upper part 14 each exhibit an edge 16 and 18 respectively, wherein the edges 16 and 18 are joined to each other fluid-tight and gas-tight when the apparatus upper part 14 is set onto the apparatus lower part 12. Closing elements not shown in the drawing that are known in principle are provided to lock the apparatus upper part 14 to the apparatus lower part 12.

The apparatus lower part 12 comprises a container 20 that defines a container interior 22. The container 20 exhibits a bottom wall 24 preferably holding a chassis, opposing side walls 26 and 28, as well as a front wall 30 and a hack wall 32.

Position and orientation terms such as "front wall," "back wall," or the like are to be understood here as referring to an operating position of the suction apparatus 10 in which the apparatus rests on the floor.

Figure 8:
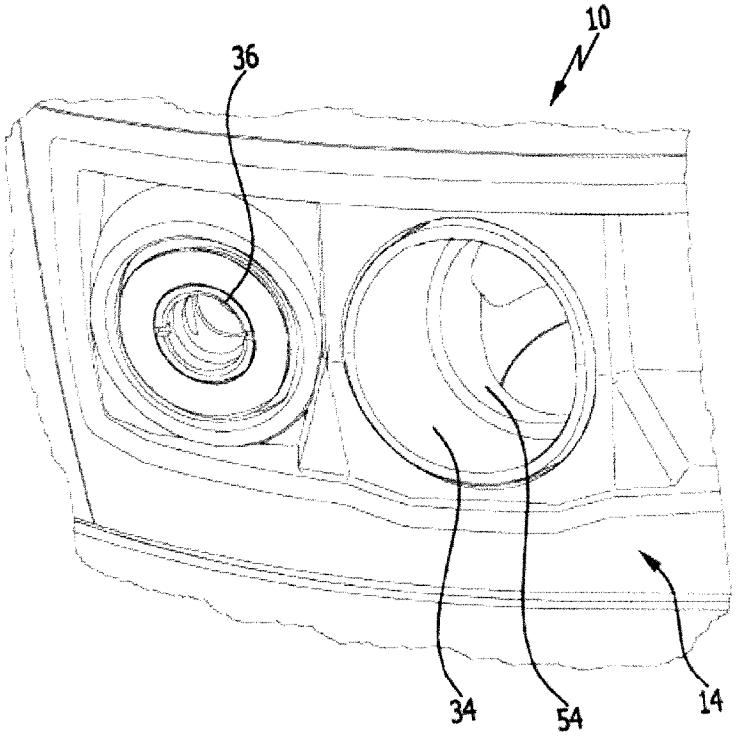
FIG. 8: a sectional representation of the suction apparatus with a suction inlet and a fluid outlet.

A suction inlet 34 (FIG. 8) is arranged on a front side of the suction apparatus 10, in particular on the apparatus upper part 14. Further, on the front side a fluid outlet 36 is arranged on the suction apparatus 10, in particular on apparatus upper part 14.

Figure 2:
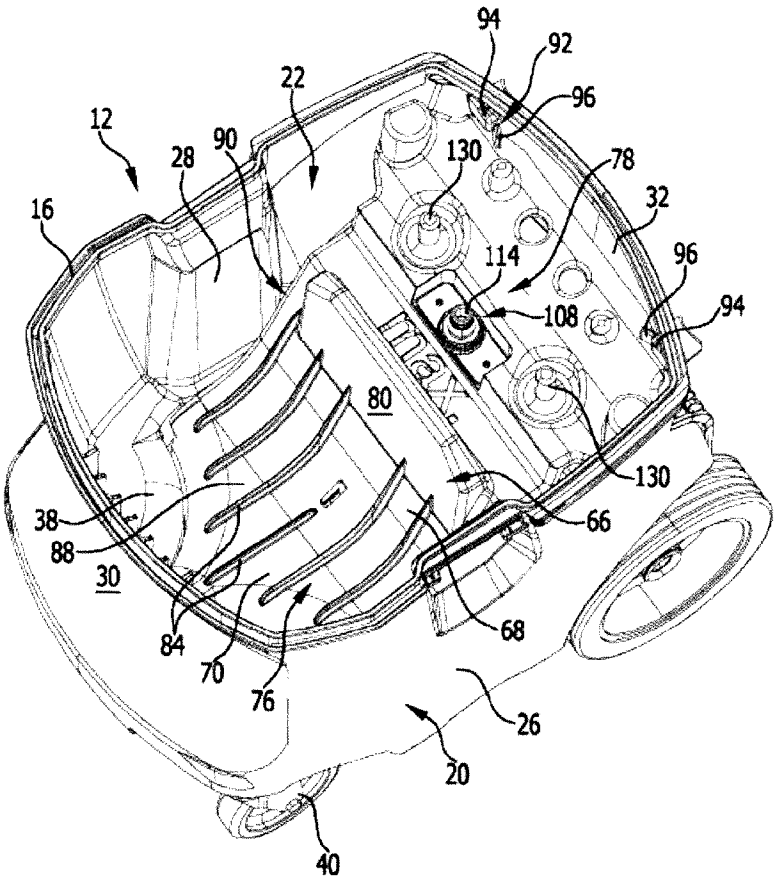
FIG. 2: the apparatus lower part in a perspective representation.
Figure 3:
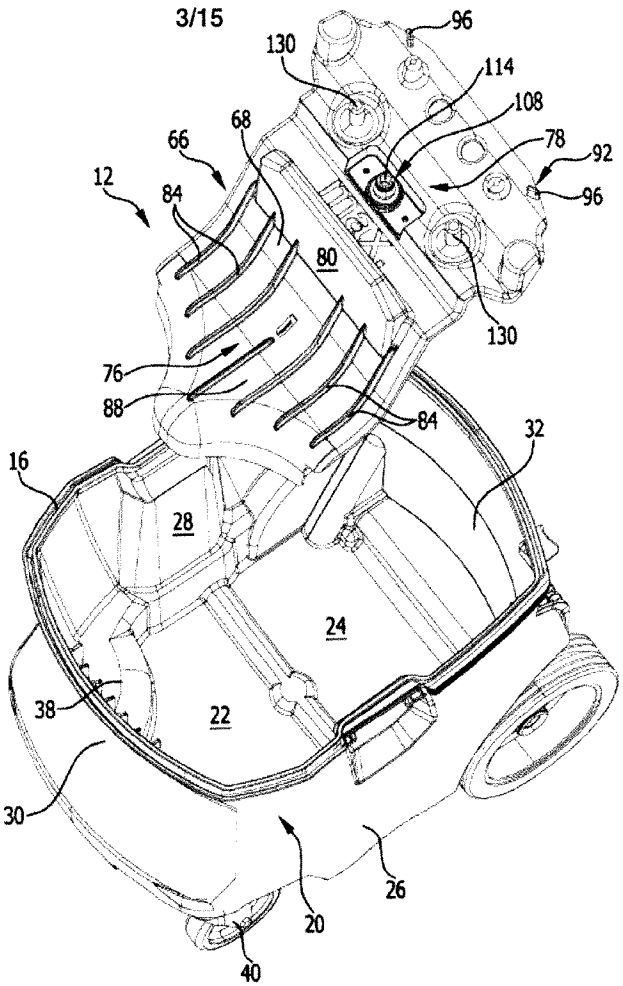
FIG. 3: the apparatus lower part in a perspective exploded representation.
Figure 4:
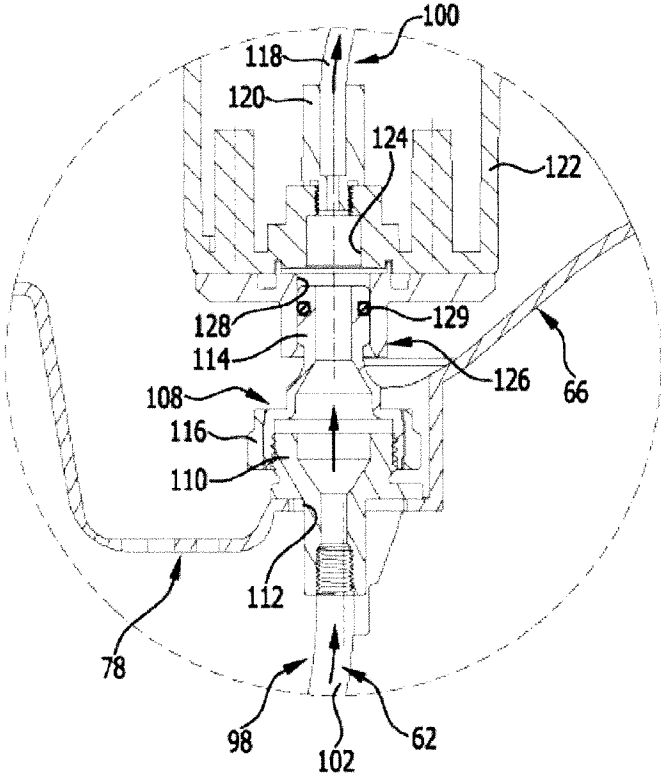
FIG. 4: an enlarged representation of Detail A in FIG. 1.

The bottom wall 24 has raised ledges 38 facing the front wall 30 (only one ledge is shown in FIGS. 1 to 3). The ledges are each curved and distanced from each other via an intermediate space not shown in the drawing. Castors 40 of the chassis are positioned below the ledges 38.

Figure 7:
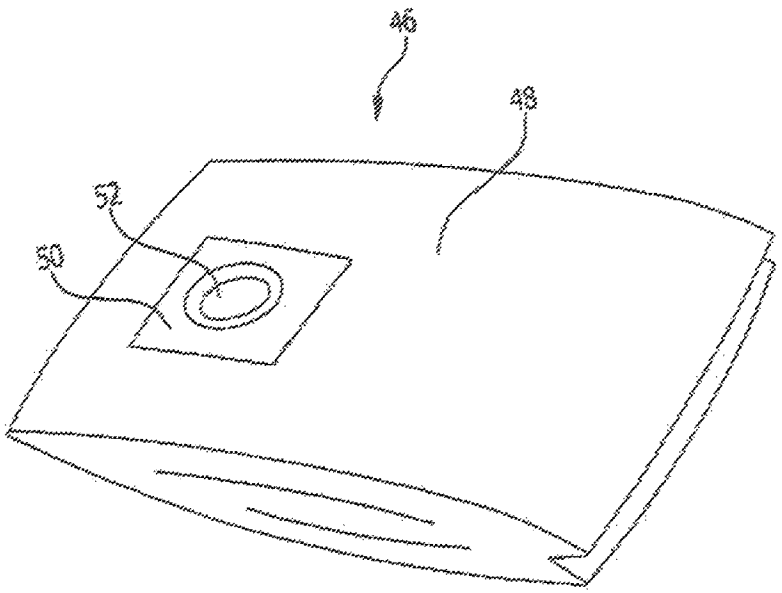
FIG. 7: a schematic perspective representation of the filter bag of the suction apparatus.

A receiving element 42, shown only in FIG. 1, is arranged at the front wall 30. The receiving element 42 serves to receive a holding element 44 for a filter element 46 of the suction apparatus 10. FIG. 7 shows the filter element in a schematic representation. In FIG. 1, an outline of the inflated filter element is shown by means of a dashed line.

The filter element 46 is a filter hag 48. The filter bag 48 is in particular a non-woven filter bag. The filter bag 48 comprises a holding section 50 where an entry opening 52 is arranged. The holding section 50 can be detachably attached to the holding element 44. The holding element 44 can be connected to the receiving element 42, preferably through mounting. For easy handling of the filter bag 48, this element therefore can be preferably attached to the container 20 by hanging. Conversely, the filter bag 48 can be removed from the container 20 by unmounting the holding element 44 and then the holding element 44 can be separated from the filter bag 48 so that the bag can be disposed of.

A suction nozzle 54 forming the suction inlet 34 is arranged at the apparatus upper part 14.

The suction nozzle 54, when the apparatus upper part 14 rests on the apparatus lower part 12, can engage with a lower section in the filter bag 48. The suction nozzle 54 reaches through the entry opening 52. A sealing element 56 is preferably arranged at the edge of the entry opening 52, for example in the form of a sealing lip.

The suction apparatus 10 exhibits a suction subassembly 58 arranged in the apparatus upper part 14 in order to generate negative pressure in the container interior 22 so that a mixture made up of the carrier fluid and particles of dirt can be taken in to the filter hag 48 through the suction hose, not shown in the drawing, and the suction nozzle 54. The suctioning takes place through the filter bag 48. The particles of dirt are restrained by the filter bag 48, and cleaned (carrier) fluid can pass through the filter hag 48 and enter the container interior 22. If the filter hag 48 is charged with negative pressure, it inflates, as is shown schematically in FIG. 1 by means of the contour of the filter bag 48.

The suction apparatus 10 further comprises a pumping subassembly 60, which is arranged here in the apparatus upper part 14. To a suction side of the pumping subassembly 60, a feed line 62 is attached, the configuration of which will be discussed below in detail. A sectionally represented discharge line 64 is connected to a pressure side of the pumping subassembly 60. The discharge line forms the fluid outlet 36 to which a hose line can be connected.

The cleaned up fluid from the container interior 22 outside the filter bag 48 can be suctioned by the pumping subassembly 60 via the feed line 62 and delivered to the fluid outlet 36 via the discharge line 64.

With regard to operating a conventional suction apparatus, the fluid level can increase by inflating a filter bag, in particular when starting up the suction apparatus or when there is surge-like loading with a mixture made up of fluid and particles of dirt.

There is the risk that individual fluid droplets will be taken in by the suction subassembly and that its function will be impaired. This risk is minimized for the suction apparatus 10.

It is further desirable to achieve maximum reliable functioning of the suction apparatus 10 for which the fluid is freed from particles of dirt as effectively as possible and for which the feed line 62 if possible is not blocked by the inflating filter bag 48 or any particles of dirt outside the filter bag 48 in the container interior 22. For example, this is intended to minimize the risk of not supplying an electric tool connected to the suction apparatus with enough fluid, for example a core boring machine.

For this purpose, the suction apparatus 10 exhibits a filter element restraining part 66 (for simplification, referred to below as restraining part 66). The restraining part 66 is an integral part of the apparatus lower part 12 and is arranged in the container interior 22. Preferably, the restraining part 66 is manufactured in a single piece and/or made of a synthetic material.

The restraining part 66 forms a partition wall 68 that subdivides the container interior 22 into a filter bag accommodating space 70 for the filter bag 48 and a fluid delivery space 72 from which fluid is delivered via the feed line 62. The filter bag accommodating space 70 is referred to below as accommodating space 70 for simplification, and the fluid delivery space 72 is referred to below as delivery space 72 for simplification.

As is clear in particular from FIGS. 1 to 3, the partition wall 68, with reference to a longitudinal direction 74 of the suction apparatus 10, is roughly step-shaped. The partition wall 68 forms a first ledge 76, which faces the front wall 30, and a second ledge 78, which faces the back wall 32. The ledges 76 and 78 are connected to each other via a vertically extending bracing section 80.

In the longitudinal direction 74, the bracing section 80 is arranged roughly in the center between the front wall 30 and the back wall 32. The bracing section 80 transitions in a curve into the first ledge 76. The partition wall 68, facing the front wall 30, thereby exhibits a roughly half-channel form.

Both the first ledge 71 and the bracing section 80 are flat.

But projecting elements in the form of ribs 84 are provided. A plurality of ribs 84 are distanced from each other transverse to the longitudinal direction 74 and extend over the curvature by which the bracing section 80 is connected to the first ledge 76.

The first ledge 76 on its side facing the front wall 30 is bent downward toward the bottom wall 24 and rests on the bottom wall 86. As a result, the restraining part 66 rests against the bottom wall 24.

Between the first ledge 76 and the bottom wall 24, an area 86 is arranged that is an integral part of the delivery space 72.

The first ledge 76 forms a support section 88 for the filter bag 48, and the bracing section 80 forms a contact section for the filter bag. In an inflated state, the filter bag can expand in the accommodating space 70, which is limited on the bottom by the support section 88 and the ledges 38, in the back by the bracing section 80, in the front by the front wall 30, and laterally by sections of the side walls 26, 28. The filter bag can rest on the support section 88 by which the load can be diverted onto the bottom wall 24. In addition, the bracing section 80 likewise accommodates a part of the load of the filter bag 48.

Figure 5:
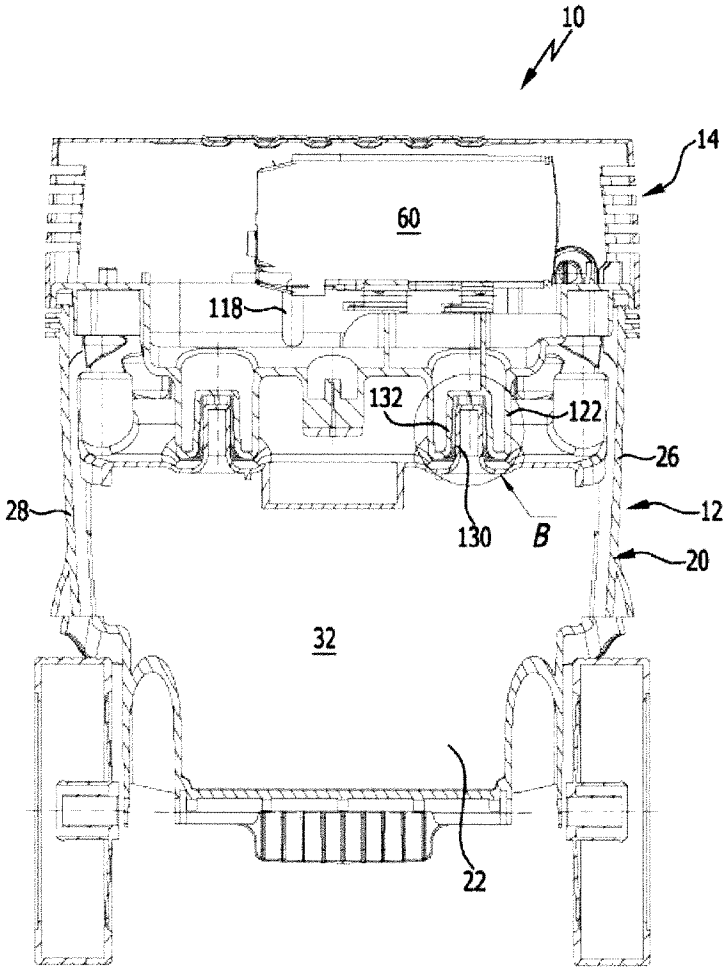
FIG. 5: a sectional view along the line 5-5 in FIG. 1.

The second ledge 78 extends from the support section 80 to the back wall 32, so the restraining part 66 can rest against the back wall 32. In a longitudinal direction 74, a support takes place as a result on the back wall 32 in the back on one side and against the ledges 38 in the front on the other side. The restraining part 66 is thereby arranged in the longitudinal direction 74 immovably in the container interior 22. Transverse of the longitudinal direction 74, intermediate spaces 90 are present in each case between the restraining part 66 and the side walls 26, 28 (FIGS. 2 and 5). Via the intermediate spaces 90, there is a fluid connection from the accommodating space 70 into the delivery space 72, whereby filtered fluid can flow past the restraining part 66.

The delivery space 72 is limited on top by the support section 88 (in area 86), the bracing section 80, and the second ledge 78. On the bottom, the delivery space 72 is limited by the bottom wall 24. On the side and in the hack, the delivery space 72 is limited by sections of the side walls 26, 28 and by the back wall 32, respectively.

The partition wall 68 is accordingly configured so that the accommodating space 70 and the delivery space 72 are arranged in the longitudinal direction. 74 laterally next to each other, whereby the accommodating space 70 is arranged above, and the delivery space 72 below the partition wall 68. In the area 86, the accommodating space 70 is additionally arranged above the delivery space 72.

Figure 9:
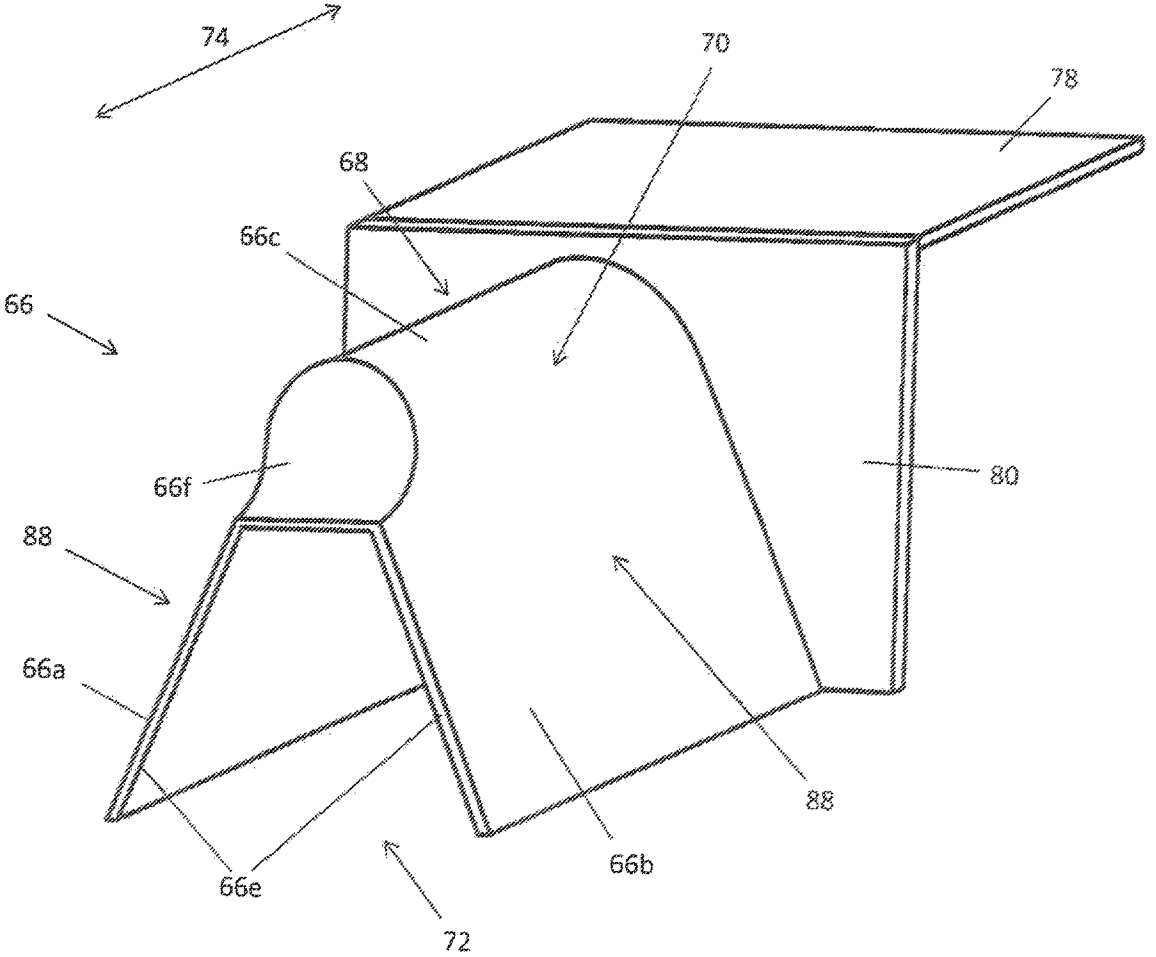
FIG. 9: a perspective view of a restraining part according to the invention in accordance with another embodiment.
Figure 13:
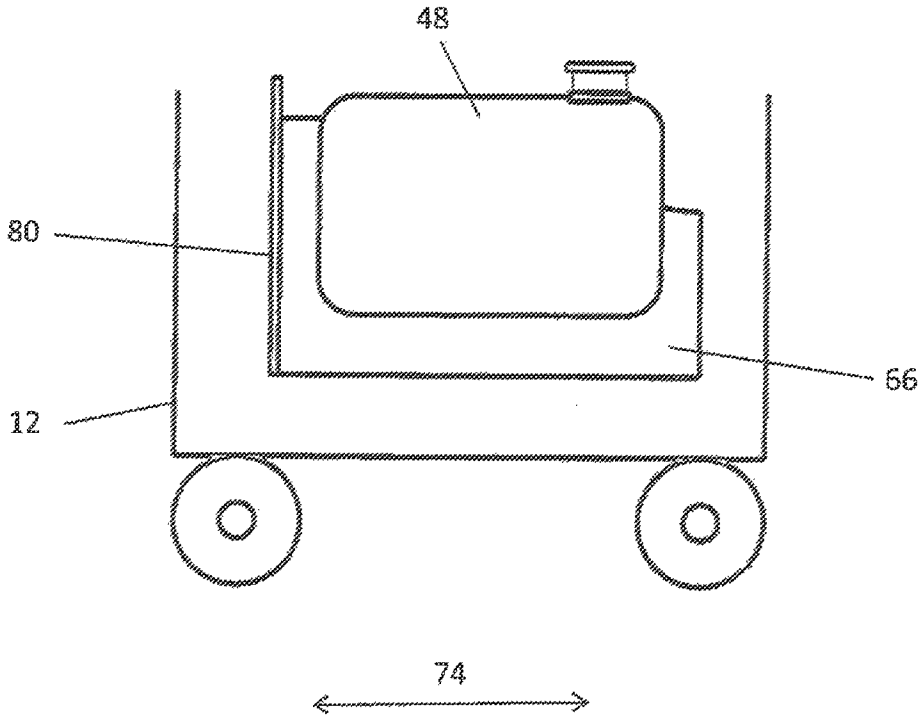
FIG. 13: a side view of the restraining part according to the further embodiment in an apparatus lower part with the filter bag on the restraining part.
Figure 14:
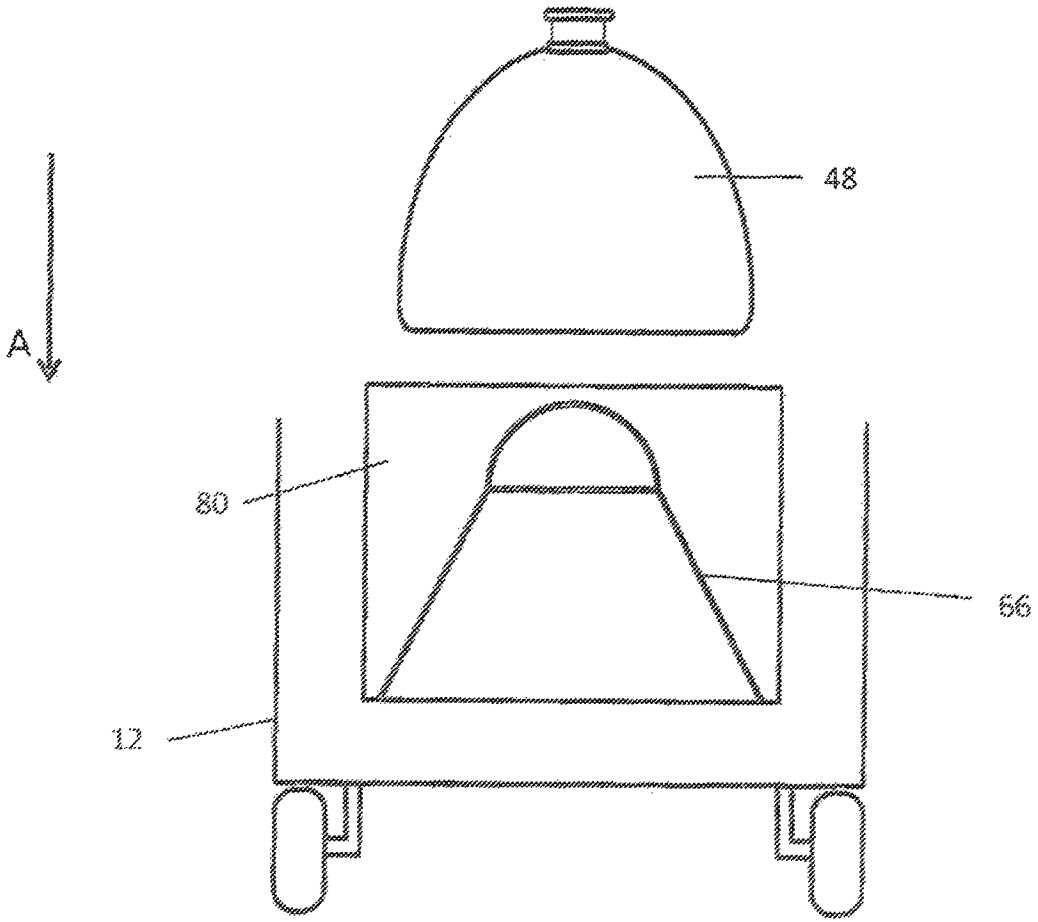
FIG. 14: a front view of the restraining part according to the further embodiment in an apparatus lower part with the filter bag over the restraining part.
Figure 15:
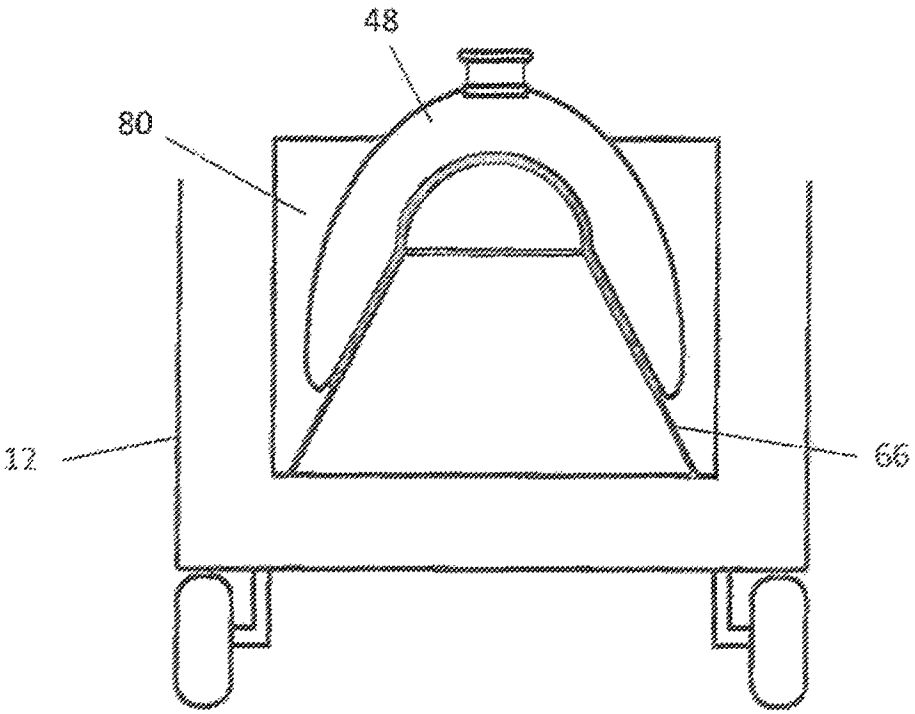
FIG. 15: a front view of the restraining part according to the further embodiment in an apparatus lower part with the filter bag on the restraining part.

According to a further or alternative embodiment of the present invention, it is possible that the restraining part 66 is substantially configured in the form of a saddle (see FIG. 9). For that purpose, the restraining part 66 contains a first area element 66*a* and a second area element 66*b*. The first area element 66*a* and the second area element 66*b* are connected to each other in each case at the upper side edges 166*a*, 166*b*. The connection 66*c* is accordingly round or rounded off. The restraining part 66 according to this alternative embodiment substantially appears as having been formed of a bent surface. The connection 66*c* is round or rounded off so that, as shown in FIGS. 13 and 15, a filter bag 48, which is laid onto the restraining part 66, is not damaged or excessively pushed-in in areas. The subtle-shaped configuration of the restraining part 62 substantially serves to distribute the filter bag 48, which is laid onto the restraining part 66, uniformly, i.e., in equal parts over the first area element 66*a* and the second area element 66*b*, and thereby form the greatest possible delivery space 72 under the restraining part 66.

Figure 12:
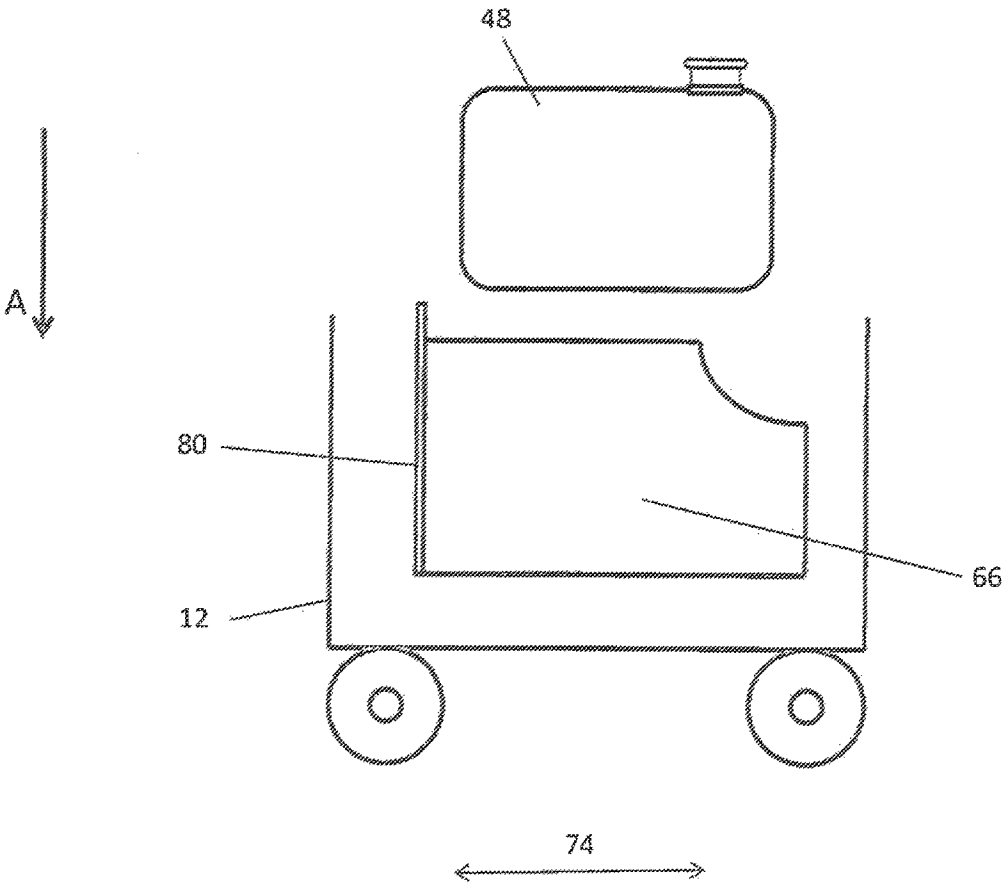
FIG. 12: a side view of the restraining part according to the further embodiment in an apparatus lower part with the filter bag over the restraining part.

As FIGS. 9, 12, and 13 show, the bracing section 80 is formed as a plate as a repository section for the filter bag 48 and is positioned at a hack side 66*d* of the restraining part 66. As previously described above, the second ledge 78 substantially extends at a right angle (i.e., approximately 90°) to the bracing section 80 (see FIG. 9).

Furthermore, the restraining part 66 according to this alternative embodiment between a front side 66*e* and the connection 66*c* of the restraining part 66 exhibits an indentation 66*f*, which serves as an overflow between the accommodating space 70 and the delivery space 72. (See FIG. 9). The indentation 66*f* substantially exhibits a curved spine. The curved spine serves to form an upper rounded-off edge to the connection 66*c*. The rounded-off edge in turn serves to protect the filter bag 48, resting on the restraining part 66.

As FIGS. 12 to 15 show, the filter bag 48 is positioned from above in direction A onto the reserved part 66. The flat filter bag 48 is distributed, as shown in FIG. 15, substantially in equal proportions on the first area element 66*a* and second area element 66*b*.

Figure 10:
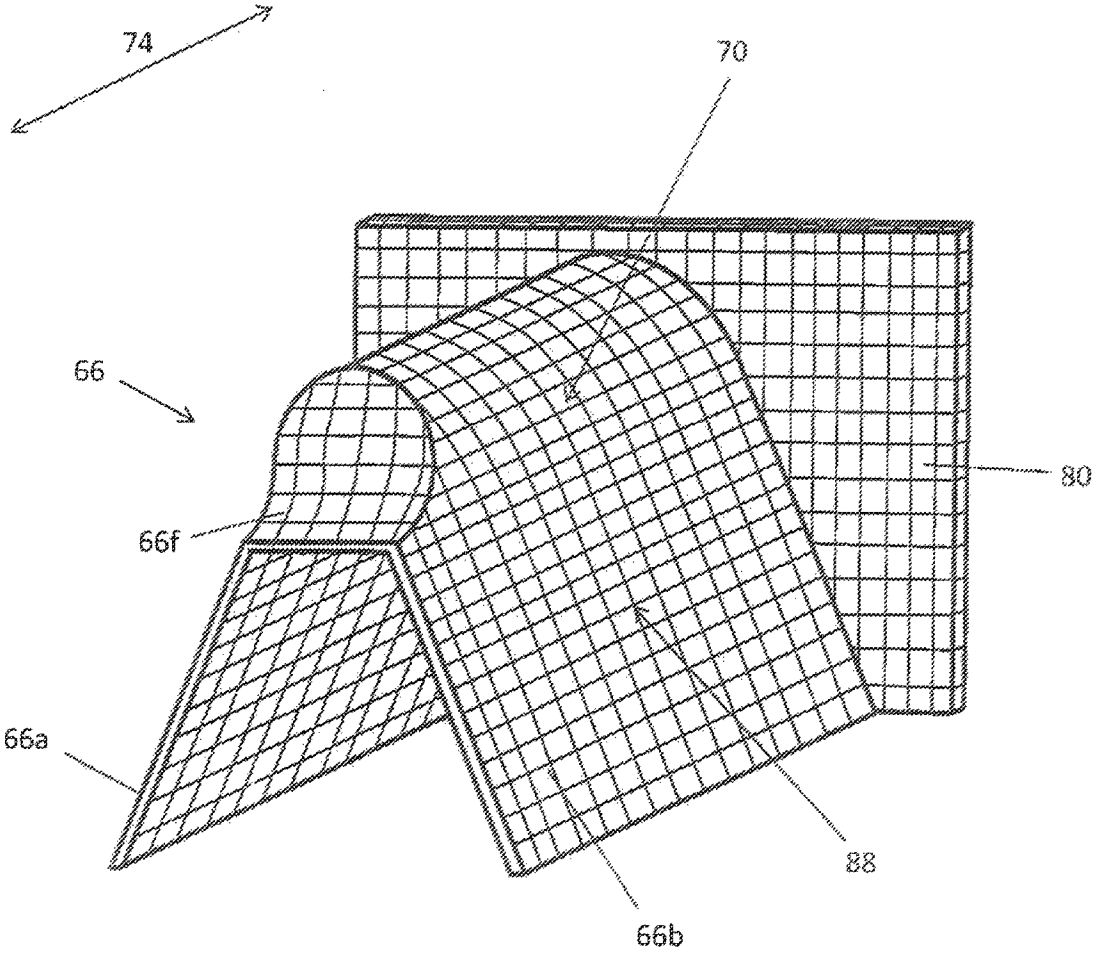
FIG. 10: another perspective view of a restraining part according to the invention in accordance with another embodiment.
Figure 11:
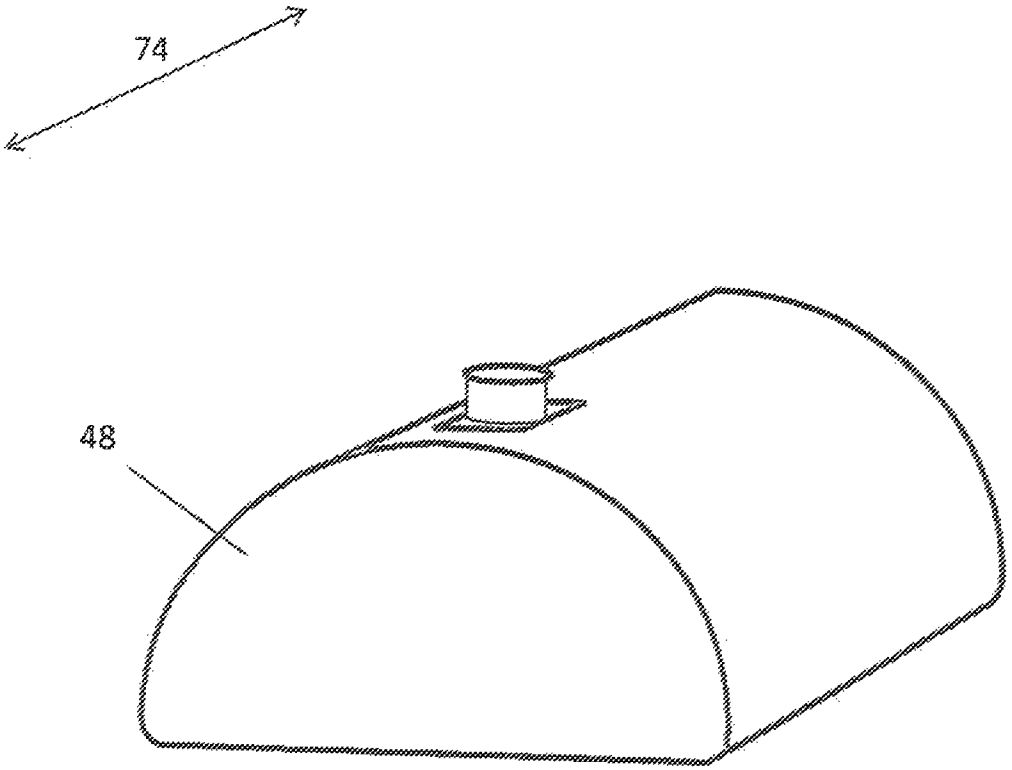
FIG. 11: a perspective view of a filter bag.

The restraining part 66 according to this alternative embodiment, i.e., the first area element 66*a*, the second area element 66*b*, the bracing section 80, and the indentation 66*f*, are configured in the form of fluid-permeable elements. These fluid-permeable elements can be plates with holes. It is likewise possible that the fluid-permeable elements are formed in the shape of grids (see FIG. 10). With the help of the fluid-permeable elements, a fluid (e.g., water that has been suctioned up) can reach from the accommodating space 70 to the delivery space 72 through the restraining part 66 and collect in the delivery space 72.

The restraining part 66 can be detachably fixed in the container 20 via a fixing device 92. The fixing device 92 is arranged at the back wall 32, and in particular configured as a latching device. The fixing device 92 comprises latching projections 94 at the hack wall that can couple with latching projections 96, correspondingly formed for that purpose, at the second ledge 78.

The restraining part 66 can be inserted into the container interior 22 from above until the first ledge rests at the bottom on the bottom wall 24 and at the front against the ledges 38. The latching projections 94, 96 latch with each other impacting the second ledge 78 with a force directed at the bottom wall 24. As mentioned, the restraining part. 66 is then held in the container 20 immovably in longitudinal direction 74. Vertically, facing away from the bottom wall 24, the restraining part 66 is fixed by latching with the container 20.

The feed line 62 comprises a first line section 98 and a second line section 100. The line section 98 comprises a hose line 102 that is arranged in the delivery space 72 (FIG.

1). At an end of the hose line 102, an entry opening 104 is formed, whereby preferably an additional filter element 106 is arranged at the entry opening 104.

The hose line 102 is held, for example, by latching to the partition wall 68 (FIG. 1). Preferably, the entry opening 104 is positioned at a distance from the bottom wall 24 and/or at a distance to the side walls 26, 28. In the present case, the entry opening 104 is arranged in the area of the curvature by which the bracing section 80 is connected to the support section 88.

The line section 98 further comprises a connecting element 108 that is held at the second ledge 78. The ledge 78 forms a holding part for the connecting element 108. The connecting element 108 comprises an adapter part 110 that sectionally reaches through a passage 112, which is formed in the second ledge 78. The adapter part 110 on the top contacts the second ledge 78 like a flange and is connected to it for example by a screw connection. In the delivery space 72, the hose line 102 is preferably connected detachably to the adapter part 110, for example through a screw connection.

The connecting element 108 further comprises a connection nub 114, which above the second ledge 78 is set onto the adapter part 110 and is connected to this, for example, by a screw connection. To secure the connecting element 108 to the adapter part 110, the connecting element 108 exhibits a fixing element 116 encircling the connecting nub 114.

The connecting nub 114 sticks out from the second ledge 78 in the direction of the apparatus upper part 14.

The second line in section 100 comprises a hose line 118, connected on the suction side to the pumping subassembly 60, at the end of which line, facing away from the pumping subassembly 60, a coupling piece 120 is arranged. The coupling piece is connected, for example, to a bottom wall 122 of the apparatus upper part 14 by a screw connection. A passage 124 is formed in the bottom wall 122. On the side facing the second ledge 78, a connecting element 126 is arranged at the bottom wall 122. The connecting element 126 contacts the bottom wall 122 like a flange and is connected to this wall by a screw connection. The connecting element 126 forms a socket 128 for the connecting nub 114 of the connecting element 108.

If the apparatus upper part 14 is set onto the apparatus lower part 12, the connecting elements 108 and 126 couple with each other in that the connecting nub 114 engages in the socket 128. There is a fluid-tight connection between the line sections 98 and 100 via the connecting elements 108 and 126, respectively. A sealing element 129 seals between the connecting nub 114 and the socket 128.

Conversely, the connecting elements 108, 126 are separated from each other when the apparatus upper part 14 is lifted from the apparatus lower part 12.

The above configuration of the suction apparatus 10 proves to be especially advantageous. The line feed 62 with both line sections 98, 100 is provided to a certain extent "automatically," when the apparatus upper part 14 occupies its target position relative to the apparatus lower part 12. Correspondingly, the feed line 62 is automatically separated when the apparatus upper part 14 is lifted.

Orienting elements 130 are arranged at the restraining part 66, in particular at the second ledge 72. The orienting elements 130 are configured as pin-like projections. The orienting elements 130 are arranged transverse of the longitudinal direction 74 on both sides of the connecting element 108, so that the connecting element 108 is positioned roughly between the orienting elements 130 (it is also somewhat offset towards the front in longitudinal direction 74).

Corresponding orienting elements 132 are assigned to the orienting elements 130.

The orienting elements 132 are configured as blind hole-shaped socket 128, which are formed in the bottom wall 122 of the apparatus upper part 14.

If the apparatus upper part 14 is set onto the apparatus lower part 12, the orienting elements 130 can interact with the orienting elements 132 and make it easier for a user to assemble the suction apparatus 10. The projections can engage in the blind hole-like sockets in order to secure movement of the apparatus upper part 14 into the desired target position at the apparatus lower part 12.

At the same time, the connecting elements 108 and 126 are oriented to each other so that they can couple with each other fluid-tight.

Figure 6:
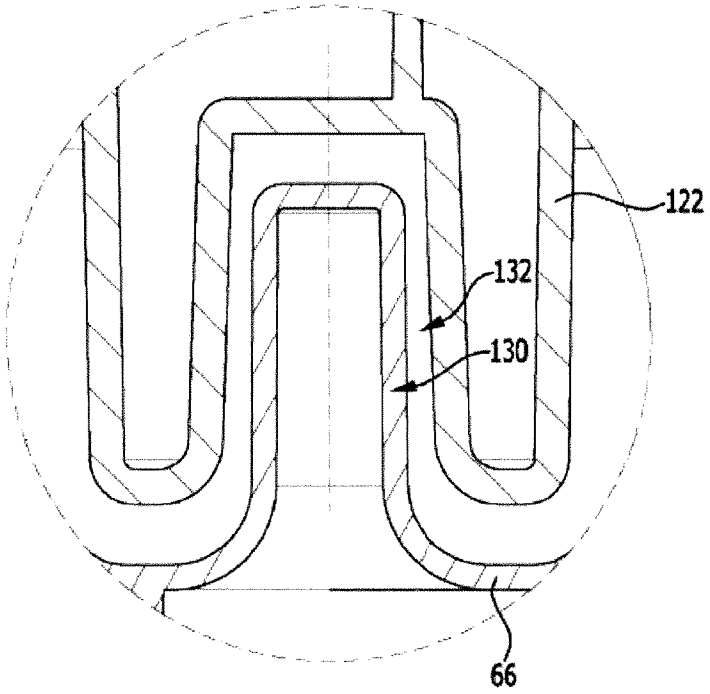
FIG. 6: an enlarged representation of Detail B in FIG. 5.

FIG. 5 and especially FIG. 6 show that the projections 130 engage in the sockets 132 with some play. This prevents the projections 130 from jamming with the sockets 132, which simplifies handling of the suction apparatus 10.

For the suction apparatus 10, the mixture made of carrier fluid and particles of dirt is taken in by the suction subassembly 58 through the filter bag 48.

Particles of dirt can be reliably separated therein. The weight of the filter bag 48 can be diverted to the container 20 via the partition wall 68. The filter bag 48 is reliably supported by the support section 88 and the bracing section 80. The ribs 84 ensure that the filter bag 48 does not stick continuously flat on the support section 88 and on the bracing section 80. Instead, fluid can also exit on the bottom from the filter bag 48 and can reach the delivery space past the partition wall 68.

The majority of fluid, however, will exit above the settled particles of dirt from the filter bag 48 and likewise reach the delivery space 72 past the partition wall 68, in particular through the intermediate spaces 90.

The restraining part 66 ensures that the inflated filter bag 48 will not displace any fluid in the container interior 22. This can prevent displaced fluid from undesirably reaching the suction subassembly 58 and impairing its function. It is further avoided that an inflating filter bag will block the feed line 62, for example, because it blocks the entry opening 104 for example by lying against the opening. Instead, the feed line 62 with the line section 98 is arranged in the delivery space 72 into which the filter hag 48 cannot expand due to the restraining part 66. This ensures that fluid can be delivered by the pumping subassembly 60 at all times.

The distance between the entry opening 104 and the bottom wall 24 and the side walls 26, 68 additionally ensures that any particles of dirt entering the delivery space 72 if possible do not reach the feed line 62 and clog it.

Further, it turns out to be advantageous that the volume of the accommodating space 70 is lower than the volume of the filter hag 48 in the maximum inflated state. In other words, the filter bag 48 is prevented by the restraining part 66 from taking up its maximum volume. By providing the filter bag 48 with in principle oversize volume, however, a large filter area is provided by which effective extraction can take place.

The disproportionate expansion of the filter bag 48, however, is prevented by the restraining part 66.

For a different, advantageous embodiment, not shown in the drawing, of the suction apparatus according to the invention, it can be provided that a submersible pump is present in the delivery space 72 instead of the pumping subassembly 60 in the apparatus upper part, as has already been mentioned above. The aforementioned advantages can likewise be achieved with such an advantageous embodiment. For this embodiment, it is provided in particular that the discharge line connected on the pressure side to the submersible pump exhibits line sections with connecting elements arranged on it, which elements can couple with each other like the connecting elements 108, 126 of the feed line 62 when the apparatus upper part 14 is set onto the apparatus lower part 12.

The invention claimed is:

1. A suction apparatus for cleaning purposes, comprising:

a container having a container interior;

a suction subassembly;

a changeable-shape filter element which is arrangeable in the container interior;

a pumping subassembly, wherein a mixture made up of a carrier fluid and entrained particles of dirt can be taken in via a suction inlet by negative pressure generated by the suction subassembly, wherein the particles of dirt are restrainable by the changeable-shape filter element, and wherein the carrier fluid after filtering by the changeable-shape filter element is deliverable by the pumping subassembly from the container interior to a fluid outlet;

wherein the changeable-shape filter element is a filter bag, wherein the mixture can be taken into the filter bag by the suction subassembly; and a filter bag restraining part that subdivides the container interior into a filter bag accommodating space and a fluid delivery space, wherein the filter bag is disposed in the filter bag accommodating space and is prevented by the filter bag restraining part from expanding into the fluid delivery space from which carrier fluid flowing around, or through, the filter bag restraining part is delivered by the pumping subassembly from the fluid delivery space to the fluid outlet.

2. The suction apparatus according to claim 1, wherein a volume of the filter bag in an inflated state is larger than a volume of the filter bag accommodating space and wherein the filter bag disposed in the filter bag accommodating space is prevented by the filter bag restraining part from inflating to a maximum size of the filter bag.

3. The suction apparatus according to claim 1, wherein the filter bag restraining part includes a support section for the filter bag and/or a lateral contact section for the filter bag.

4. The suction apparatus according to claim 3, wherein the support section and/or the contact section are flat.

5. The suction apparatus according to claim 3, wherein rib-shaped and/or nub-shaped projection elements are disposed at the support section and/or at the contact section such that flat contact between the filter bag and the filter bag restraining part is prevented.

6. The suction apparatus according to claim 3, wherein, between the support section and a bottom wall of the container, an area of the fluid delivery space is disposed.

7. The suction apparatus according to claim 1, wherein the filter bag restraining part has a flow-through opening.

8. The suction apparatus according to claim 1, wherein between side walls of the container and the filter bag restraining part intermediate spaces are defined.

9. The suction apparatus according to claim 1, wherein the filter bag restraining part rests against a bottom wall of the container and wherein a fixing device fixes the filter bag restraining part against vertical movement.

10. The suction apparatus according to claim 1, wherein the filter bag restraining part is detachably fixable to the container via a fixing device.

11. The suction apparatus according to claim 1, wherein the filter element restraining part includes a half-channel-shaped or channel-shaped partition wall that separates the filter bag accommodating space and the fluid delivery space from each other.

12. The suction apparatus according to claim 1, wherein the filter bag accommodating space and the fluid delivery space are equal in size.

13. The suction apparatus according to claim 1, wherein the filter bag accommodating space and the fluid delivery space are disposed laterally next to each other.

14. The suction apparatus according to claim 1, wherein the filter bag is a non-woven bag.

15. The suction apparatus according to claim 1, wherein a holding element is mounted to the container and wherein the filter bag is detachably fastenable to the holding element.

16. The suction apparatus according to claim 1, wherein the filter bag restraining part includes a display device having a fill indicator.

17. The suction apparatus according to claim 1, wherein an apparatus lower part includes the container and an apparatus upper part includes the suction subassembly and wherein the apparatus upper part is sealingly settable onto the apparatus lower part and is detachable from the apparatus lower part.

18. The suction apparatus according to claim 17, wherein the pumping subassembly is disposed in the apparatus upper part, wherein a discharge line forms the fluid outlet, wherein the discharge line is connected to a pressure side of the pumping subassembly, and wherein a feed line is connected to a suction side of the pumping subassembly and includes an entry opening arranged in the fluid delivery space for filtered carrier fluid.

19. The suction apparatus according to claim 18, wherein the entry opening is disposed at a distance from a bottom wall and/or from side walls of the container.

20. The suction apparatus according to claim 1, wherein the pumping subassembly is a submersible pump disposed in the fluid delivery space and wherein a discharge line forms the fluid outlet and the discharge line is connected to a pressure side of the submersible pump.

21. The suction apparatus according to claim 18, wherein the feed line or the discharge line includes a first line section disposed at least sectionally in the fluid delivery space and a second line section disposed at least sectionally in the apparatus upper part, wherein the first and second line sections are connected with each other fluid-tight via respective connecting elements when the apparatus upper part is set onto the apparatus lower part, and wherein the connecting elements are separated from each other when the apparatus upper part is lifted from the apparatus lower part.

22. The suction apparatus according to claim 21, wherein the connecting element of the first line section is fixed to a holding part held at the apparatus upper part.

23. The suction apparatus according to claim 22, wherein the filter bag restraining part forms the holding part.

24. The suction apparatus according to claim 21, wherein the first line section includes a hose line.

25. The suction apparatus according to claim 24, wherein the hose line is fixed to the filter bag restraining part.

26. The suction apparatus according to claim 17, wherein the apparatus upper part and the filter bag restraining part have interacting orienting elements that interact when the apparatus upper part is set onto the apparatus lower part.

27. The suction apparatus according to claim 26, wherein the orienting elements are a pin-shaped projection and a blind hole-shaped socket in which the pin-shaped projection engages.

28. The suction apparatus according to claim 21, wherein the apparatus upper part and the filter bag restraining part have interacting orienting elements that interact when the apparatus upper part is set onto the apparatus lower part and wherein the connecting elements are disposed between the orienting elements.

29. The suction apparatus according to claim 1, wherein the filter bag restraining part is a single piece and is a synthetic material.

* * * * *